US006904635B2

(12) United States Patent
Beal

(10) Patent No.: US 6,904,635 B2
(45) Date of Patent: Jun. 14, 2005

(54) SAW-MOUNTED DEBURRING PRODUCT

(76) Inventor: Lewis Beal, 336 E. Hawthorne Blvd., Wheaton, IL (US) 60187

( * ) Notice: Subject to any disclaimer, the term of this patent is extended or adjusted under 35 U.S.C. 154(b) by 0 days.

(21) Appl. No.: 10/403,655

(22) Filed: Mar. 31, 2003

(65) Prior Publication Data

US 2004/0187219 A1 Sep. 30, 2004

(51) Int. Cl.[7] ..... B26B 11/00
(52) U.S. Cl. ..... 7/158; 7/169
(58) Field of Search ..... 7/158, 169

(56) References Cited

U.S. PATENT DOCUMENTS 2,560,846 A 7/1951 Caster
3,522,617 A 8/1970 Kowal
3,763,510 A * 10/1973 Graham ..... 7/158
4,347,634 A 9/1982 Sawan
4,468,829 A * 9/1984 Christensen ..... 15/105
4,723,332 A * 2/1988 Pourtau et al. ..... 7/149
5,983,430 A * 11/1999 Clark ..... 7/144

* cited by examiner

*Primary Examiner*—Jacob K. Ackun
*Assistant Examiner*—J Williams

(57) ABSTRACT

The invention is a deburring implement which, in use, is mounted to a saw with an orientation that allows deburring after cutting without reorientation of the saw, where the deburring implement can have an internal deburring component and an outer deburring component, and where the deburring implement can be mounted to a mounting fixture that is mounted to the saw.

6 Claims, 1 Drawing Sheet

SAW-MOUNTED DEBURRING PRODUCT

The invention is a deburring product that is mounted to a saw and, when in use, has an orientation that allows deburring after cutting without reorientation of the saw. When using a saw to cut an object, the object often requires deburring to remove ragged bits of material left by the saw. By mounting the deburring product to the saw, the deburring product is easily accessible to the cut object after cutting. Furthermore, the position and orientation of the deburring product enable a person to cut and debur while minimizing possibly harmful, repetitive hand and arm motions.

Cutting conduit, pipe, and other objects in the field is a regular practice for electricians and various tradespeople. After cutting, a cut object is often left with burrs around the periphery of the cut surface. The burrs can cause damage to electric wires, injury to a person handling the cut object, and impede assembly of the cut object with other fittings. In order to prevent these problems, the burrs are often removed using specialized deburring tools and other implements, such as pliers.

A typical method for cutting objects in the field involves a person gripping the object in one hand and cutting the object using a saw gripped in their other hand. The deburring product is mounted rigidly to the saw so that the deburring product is easily accessible to the cut object after cutting. The deburring product is oriented so that the cut object, after cutting, is substantially in the requisite position for deburring. Only the small translation of the cut object from the cutting position to the deburring position is required to facilitate deburring. Because of its convenient mounting position and unique orientation, cutting and deburring with the deburring product can be accomplished using minimal motion of the hands and limbs.

The deburring product in use is mounted rigidly to a saw. The saw has a handle and a blade. Some types of saws may not have distinctly defined handles, such as small circular saws that can be held by placing a hand around the motor housing. The handle, here and throughout, is defined as the part of the saw that is gripped by the hand when the saw is in use.

Figure 1:
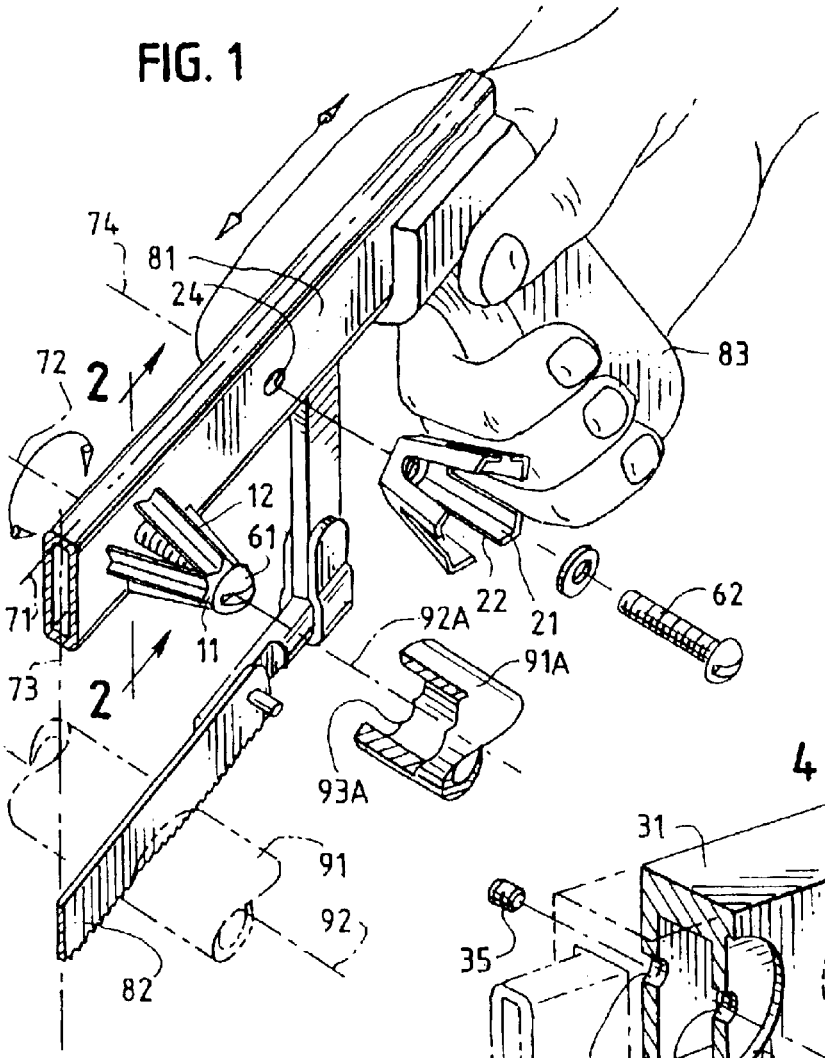
FIG. 1 is a perspective view of the deburring product.

The saw is adapted to cut substantially in a cutting plane. Relative motion between the blade and the cut object removes material from the cut object. The motion of the blade as it moves through the cut object defines the cutting plane. The saw has a long axis that is in the cutting plane. The saw has a normal axis that is in the cutting plane and is orthogonal to the long axis. The saw has a lateral axis that is orthogonal to both the long axis and the normal axis. In FIG. 1, for example, the long axis 71 is in the cutting plane, the normal axis 73 is in the cutting plane and orthogonal to the long axis 71, and the lateral axis 72 is orthogonal to the long axis 71 and the normal axis 73.

The deburring product can be mounted to various types of saws, including manual and motor-driven saws. Motor-driven saws include reciprocating and circular saws where the motor moves the saw blade in a cutting motion with respect to the saw handle.

The saw can be a hacksaw as shown in FIG. 1. The hacksaw has a frame 81, a blade 82, and a handle 83. In use the blade 82 moves in a reciprocating motion along the long axis 71. As the blade reciprocates along the long axis, each pass removes material from a cut object 91 substantially in the direction of the normal axis 73. In use the blade moves through the cut object substantially along the normal axis and perpendicular to the long axis. The long axis and the normal axis are in the cutting plane.

In some saws the blade position can be changed from the ordinary position to enable cutting in confined spaces and around obstructions. For example, in FIG. 1 the blade 82 is shown in the ordinary position. However, the blade can be rotated with respect to the frame 81 to provide additional clearance when cutting a conduit that is close to the ceiling. The cutting plane, here and throughout, is defined by the ordinary position of the saw blade.

The saw can be a circular saw. The circular saw has a circular blade that rotates with respect to the handle. In use, as the circular blade rotates, the blade motion removes material from the cut object substantially tangentially to circular blade periphery. In use the circular blade moves through the cut object substantially in a cutting plane.

The circular saw has a long axis that is in the cutting plane. The circular saw has a normal axis that is in the cutting plane and orthogonal to the long axis. The circular saw has a lateral axis that is orthogonal to both the long axis and the normal axis.

Alternatively, the saw can be a motor-driven reciprocating saw. The motor-driven reciprocating saw can have a blade that moves in a reciprocating motion along a long axis with respect to the saw handle. Each pass of the blade removes material from a cut object substantially in the direction of a normal axis. The normal axis is orthogonal to the long axis. Both the long axis and the normal axis are in a cutting plane. The saw has a lateral axis that is orthogonal to both the long axis and the normal axis.

In use the deburring product moves with the saw handle. This is especially important when the blade moves independently of the handle, such as when the saw is motor-driven. The deburring action is performed using hand motions and requires the deburring product to be moved by hand rather than by a motor.

The deburring product comprises a deburring implement. The deburring implement is adapted to debur a periphery that is formed by the saw blade moving in the cutting plane through the cut object. The periphery is substantially in a cut plane. The periphery can be around the object outer surface. When the object is hollow, such as a pipe and a conduit, the periphery can be around the inner surface.

The deburring implement has a deburring axis that is substantially perpendicular to the cut plane. To debur a cut object, the periphery is placed in contact with the deburring implement. The cut object can be rotated about an axis parallel to the deburring axis to remove the burrs. Alternatively, the deburring implement can be rotated about an axis parallel to the deburring axis. Alternatively, the deburring implement and the cut object can be simultaneously counter-rotated about an axis parallel to the deburring axis.

The deburring implement can be an inside deburrer. The inside deburrer is adapted to deburring an inner periphery of a hollow cut object.

The deburring implement can be an outside deburrer. The outside deburrer is adapted to debur an outer periphery of a cut object.

The deburring implement can have both an inside deburring component for deburring an inner periphery, and an outside deburring component for deburring an outer periphery.

A deburring implement that is an inside deburrer is shown in FIG. 1. The inside deburrer 11 can have an inside plurality of inside edges, such as the inside edge 12. The inside edges 12 are positioned around a deburring axis 72 and the inside edges are facing outwards from the deburring axis The inside deburrer 11 has inside edges inclined towards the deburring axis. This position and inclination facilitates deburring cut objects with various inside diameters. The inside edges can be positioned in various patterns around the deburring axis, such as patterns that facilitate deburring non-circular cut objects. The inside deburrer can have additional edges that provide various functions such as clearing deburred fragments from the inside deburrer.

The inside edges can be straight as shown in FIG. 1. Alternatively, the inside edges can have various shapes such as curved, angled, stepped, and combinations thereof. The inside edges can be inclined as shown in FIG. 1. Alternatively, the inside edges can be inclined at various angles with respect to the deburring axis. The inside edges can be formed or machined into the surface of the deburring implement. The inside edges can be removable and replaceable. The inside edges can comprise abrasive particles.

A deburring implement that is an outside deburrer is shown in FIG. 1. The outside deburrer 21 can have an outside plurality of outside edges, such as the outside edge 22. The outside edges are positioned around a deburring axis 74 and are facing inwards to the deburring axis. The outside deburrer 21 has outside edges inclined towards the deburring axis. This position and inclination facilitates deburring cut objects with various outside diameters. The outside edges can be positioned in various patterns around the deburring axis, such as patterns that facilitate deburring non-circular cut objects. The outside deburrer can have additional edges that provide various functions such as clearing deburred fragments from the outside deburrer.

The outside edges can be straight as shown in FIG. 1. The outside edges can have various shapes such as curved, angled, stepped, and combinations thereof. The outside edges can be inclined as shown in FIG. 1. Alternatively, the outside edges can be inclined at various angles with respect to the deburring axis. The outside edges can be formed or machined into the surface of the deburring implement. The outside edges can be removable and replaceable. The outside edges can comprise abrasive particles.

Figure 3:
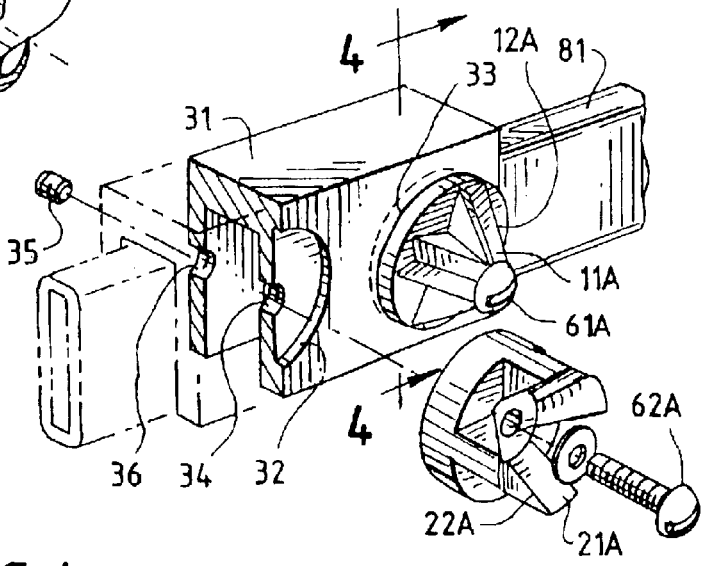
FIG. 3 is a perspective view of another embodiment of the deburring product.
Figure 2:
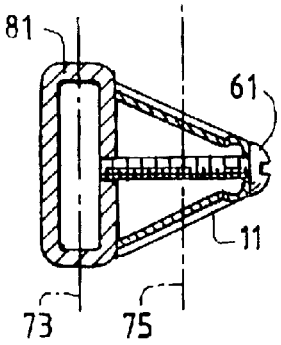
FIG. 2 is a view across line 2—2 of FIG. 1.

A deburring implement comprising an inside deburring component 11A and an outside deburring component 21A is shown in FIG. 3. Inside deburrers and inside deburring components can have similar inside edge characteristics. Inside deburrers can be interchangeable with inside deburring components. Outside deburrers and outside deburring components can have similar outside edge characteristics. Outside deburrers can be interchangeable with outside deburring components.

Inside deburrers and inside deburring components can have various numbers of inside edges such as two, three, four, or more inside edges. In FIG. 3, the inside deburring component 11A has eight inside edges 12A regularly arranged in four groups of two edges each. The four groups are equally, circularly spaced. With this inside edge arrangement, the cut object can be deburred by holding the cut surface in contact with the inside edges and rotating the cut object around the deburring axis less than one quarter revolution with respect to the inside deburring component. In FIG. 1 the inside deburrer 11 has ten inside edges 12 regularly arranged in five groups of two edges each. The five groups are equally, circularly spaced. Inside deburrers and inside deburring components can have inside edges in various arrangements, such as irregular, symmetric, asymmetric and combinations thereof.

Outside deburrers and outside deburring components can have various numbers of outside edges such as two, three, four, or more outside edges. In FIG. 3, the outside deburring component 21A has eight outside edges 22A regularly arranged in four groups of two edges each. The four groups are equally, circularly spaced. In FIG. 1, the outside deburrer 21 has ten outside edges 22 regularly arranged in five groups of two edges each. The five groups are equally, circularly spaced. Outside deburrers and outside deburring components can have outside edges in various arrangements, such as irregular, symmetric, asymmetric and combinations thereof.

The largest circular distance between any two adjacent inside edges determines the amount of rotation required to debur the cut object. An inside deburrer and an inside deburring component with fewer inside edges can require a greater rotation to achieve deburring. An inside deburrer and an inside deburring component with irregular inside edge spacing can require greater rotation to achieve deburring. In use, inside deburrers and inside deburring components requiring less rotation to debur can cause less physical stress and fewer repetitive motion injuries than inside deburrers and inside deburring components requiring more rotation to debur. Similarly, the number and spacing of the outside edges of outside deburrers and outside deburring components can affect the rotation required for deburring.

In use the saw cuts through a cut object such as 91 and 91A substantially along the cutting plane. The saw forms a periphery 93A around the cut object that is substantially in a cut plane. In this example, the cut object 91A is hollow and the periphery 93A is around the inner surface. During cutting and immediately after cutting, before the cut object is moved away from the saw, the cut plane containing the periphery 93A is parallel to the cutting plane of the saw and perpendicular to the deburring axis of the deburring implement. In this example, the deburring implement is the inside deburrer 11 with the deburring axis 72. To remove the burrs from the periphery 93A, the cut object is moved to the deburring implement while keeping the cut plane parallel to the cutting plane. When positioned for deburring, a circular cut object will contact the deburring implement along a deburring plane 75 that is substantially parallel to the cutting plane.

The cut object 91 has an object axis 92. The cut object 91A has an object axis 92A. In use the deburring axis 72 is substantially parallel to the object axis 92A of the cut object 91A during cutting and during deburring. The transition of the cut object from the cutting position to the deburring position requires only the small translation from the blade to the deburring implement. The person can transport the cut object from the cutting position to the deburring position with minimal flexion and minimal rotation of hands, wrists, and elbows.

The deburring product can be mounted rigidly to the saw via various mounting methods, such as standard fasteners and specialized mounting means. Mounting rigidly requires the deburring product be fixed in place and rotation with respect to the handle.

The deburring implement can be mounted rigidly to the saw by being mounted to a mounting fixture that is mounted to the saw.

The mounting fixture can comprise an inside mounting component. An inside deburring component can be mounted rigidly to the saw by being mounted to the inside mounting component that is mounted to the saw.

The mounting fixture can comprise an outside mounting component. An outside deburring component can be mounted rigidly to the saw by being mounted to the outside mounting component that is mounted to the saw.

The inside mounting component and the outside mounting component can be separate and interchangeable.

Other mounting means such as welding, adhesive-bonding, rivets and combinations thereof can be used provided they meet the requirements of mounting the deburring product rigidly to the saw with a deburring axis of the deburring implement perpendicular to the cutting plane and with the deburring implement moving with the handle.

In FIG. 1, the outside deburrer 21 is mounted via a threaded fastener 62 passing through the outside deburrer substantially along the deburring axis 74. The threaded fastener engages a tapped hole 24 in the saw frame 81. Similarly, the inside deburrer 11 is mounted via a threaded fastener 61. Alternatively, threaded fasteners can penetrate through-holes in the saw frame and then engage nuts to rigidly clamp on the saw frame. The deburring implement can be mounted via various off-the-shelf and specialty fasteners.

Figure 5:
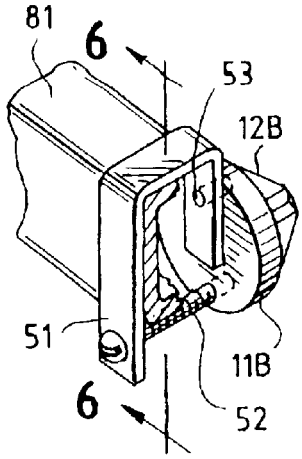
FIG. 5 is a perspective view of another embodiment of the deburring product.
Figure 6:
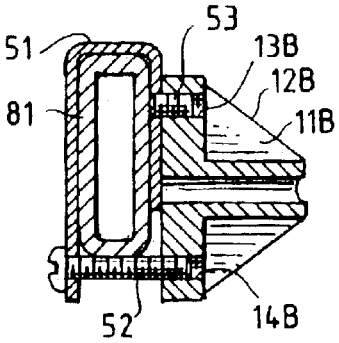
FIG. 6 is a view across line 6—6 of FIG. 5.

Alternatively, in FIG. 5 and FIG. 6, the inside deburrer 11B having inside edges 12B, is mounted to a bracket fixture 51 that mounts rigidly to the saw frame 81. The inside deburrer is mounted to the bracket fixture via a setscrew 53 that engages a bracket tapped hole and a deburrer tapped hole 13B. The bracket fixture is penetrated by a bracket mounting screw 52 that engages a mounting tapped hole 14B in the inside deburrer. When the bracket mounting screw is tightened it rigidly mounts the bracket fixture to the saw frame by clamping the bracket fixture to the frame.

Figure 4:
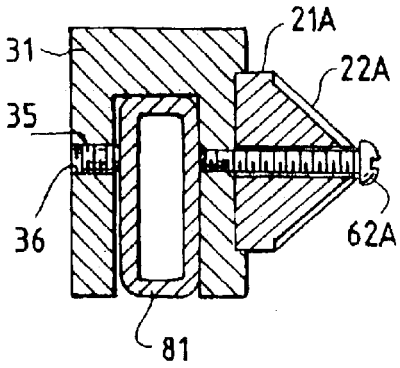
FIG. 4 is a view across line 4—4 of FIG. 3.

Alternatively, in FIG. 3 and FIG. 4, the inside deburring component 11A and the outside deburring component 21A are mounted to a dual fixture 31. The outside deburring component 21A is seated in the outside rabbet 32. The outside fastener 62A passes through the outside deburring component 21A and engages the dual outside tapped hole 34. Similarly, the inside deburring component 11A is seated in the inside rabbet 33. The inside fastener 61A passes through the inside deburring component 11A and engages the dual inside tapped hole. A dual fixture setscrew 35 engages the rear tapped hole 36 and rigidly mounts the dual fixture to the saw frame by capturing the frame within the dual fixture.

The deburring product can be manufactured using various processes such as machining, forming, casting, fabricating, and combinations thereof. In FIG. 3 the inside deburring component 11A and outside deburring component 21A are machined from solid metal stock. In FIG. 1 the inside deburrer 11 and outside deburrer 21 are formed from sheet metal stock. The deburring implement, mounting fixture, saw, and combinations thereof can be manufactured as a single unit. The deburring implement, mounting fixture, saw, and combinations thereof can be manufactured as multiple units in combinations not described here.

The deburring product can be a kit comprising deburring implement and a mounting fixture for rigidly mounting the deburring implement to a hacksaw frame. The mounting fixture orients the deburring implement so that a deburring axis is substantially perpendicular to the cutting plane.

What is claimed is:

1. A deburring product which in use is mounted to a saw, with an orientation allowing deburring after cutting without reorientation of the saw, the saw having a handle, the saw adapted to cut substantially in a cutting plane, the saw having a long axis in the cutting plane, the saw having a normal axis in the cutting plane and orthogonal to the long axis, the saw having a lateral axis orthogonal to both the long axis and the normal axis, the deburring product comprising:

a deburring implement, the deburring implement in use mounted rigidly to the saw;

the deburring implement in use moving with the handle;

the deburring implement having a deburring axis;

the deburring implement being adapted to debur around a periphery with the periphery substantially in a cut plane and with the deburring axis substantially perpendicular to the cut plane;

the deburring implement in use being mounted to the saw with the deburring axis substantially parallel to the lateral axis of the saw; and mounting means for mounting the deburring implement to the saw so that the deburring axis is substantially parallel to the lateral axis of the saw.

2. The product of claim 1 wherein the mounting means comprise a mounting fixture that is rigidly mounted to the saw.

3. A deburring product which in use is mounted to a saw, with an orientation allowing deburring after cutting without reorientation of the saw, the saw having a handle, the saw adapted to cut substantially in a cutting plane, the saw having a long axis in the cutting plane, the saw having a normal axis orthogonal to the long axis and in the cutting plane, the saw having a lateral axis orthogonal to both the long axis and the normal axis, the deburring product comprising:

a deburring implement, the deburring implement having a deburring axis;

the deburring implement being adapted to debur around a periphery with the periphery substantially in a cut plane and with the deburring axis substantially perpendicular to the cut plane;

the deburring implement in use mounted rigidly to the saw with the deburring axis substantially parallel to the lateral axis of the saw;

the deburring implement in use moving with the handle;

the deburring implement having an inside deburring component and an outside deburring component; and mounting means for mounting the deburring implement to the saw so that the deburring axis is substantially parallel to the lateral axis of the saw.

4. The product of claim 3 wherein the mounting means comprise a mounting fixture that is rigidly mounted to the saw.

5. The deburring product of claim 1 wherein the mounting means comprise at least one passage through the deburring implement, the passage in use enabling the deburring product to mount rigidly to the saw via a fastener.

6. The deburring product of claim 4 wherein the mounting fixture comprises a dual fixture.

* * * * *